US007429219B2

(12) United States Patent
Huang

(10) Patent No.: US 7,429,219 B2
(45) Date of Patent: Sep. 30, 2008

(54) GOLF CLUB HEAD HAVING A RUST-RESISTANT COATING FOR REINFORCING A SURFACE THEREOF

(75) Inventor: Chun-Yung Huang, Kaohsiung Hsien (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 434 days.

(21) Appl. No.: 11/239,237

(22) Filed: Sep. 30, 2005

(65) Prior Publication Data

US 2007/0078028 A1 Apr. 5, 2007

(51) Int. Cl.
*A63B 53/04* (2006.01)

(52) U.S. Cl. ..... 473/349; 473/342

(58) Field of Classification Search ..... None
See application file for complete search history.

(56) References Cited

U.S. PATENT DOCUMENTS

| | | | | |
|---|---|---|---|---|
| 4,704,328 | A * | 11/1987 | Imao et al. | 428/324 |
| 5,131,986 | A | 7/1992 | Harada et al. | |
| 5,171,621 | A * | 12/1992 | Desbiolles et al. | 428/141 |
| 5,207,427 | A * | 5/1993 | Saeki | 473/343 |
| 5,531,444 | A * | 7/1996 | Buettner | 473/349 |
| 6,059,670 | A * | 5/2000 | Mogan | 473/342 |
| 6,346,052 | B1 * | 2/2002 | Chappell | 473/324 |
| 6,348,011 | B1 * | 2/2002 | Reyes et al. | 473/324 |
| 6,617,050 | B2 | 9/2003 | Chao | |
| 6,638,577 | B2 * | 10/2003 | Sano et al. | 427/475 |
| 6,679,787 | B2 | 1/2004 | Unosawa | |
| 6,932,715 | B2 * | 8/2005 | Sano | 473/324 |
| 7,063,628 | B2 * | 6/2006 | Reyes et al. | 473/324 |
| 7,087,268 | B2 * | 8/2006 | Byrne et al. | 427/305 |
| 7,090,591 | B2 * | 8/2006 | Sano | 473/324 |
| 7,115,050 | B2 * | 10/2006 | Andre et al. | 473/378 |
| 7,128,947 | B2 * | 10/2006 | Hou | 427/327 |
| 7,175,539 | B2 * | 2/2007 | Sano | 473/324 |
| 7,207,901 | B2 * | 4/2007 | Sano et al. | 473/349 |
| 7,320,832 | B2 * | 1/2008 | Palumbo et al. | 428/548 |
| 2003/0082067 | A1 | 5/2003 | Chao | |
| 2005/0006007 | A1 | 1/2005 | Chao | |

FOREIGN PATENT DOCUMENTS

| | | | |
|---|---|---|---|
| JP | 11076476 A | * | 3/1999 |
| JP | 2007082615 A | * | 4/2007 |

* cited by examiner

*Primary Examiner*—Alvin A Hunter
(74) *Attorney, Agent, or Firm*—Muncy, Geissler, Olds & Lowe, PLLC

(57) ABSTRACT

A golf club head includes a rust-resistant coating layer forming on a base surface of at least one club head component of the golf club head. The rust-resistant coating layer is made from a Fe—Co—Ni alloy including iron of 5-20 wt %, cobalt of 5-25 wt % and nickel of 60-90 wt %, which is a nanometer-scaled material. The rust-resistant coating layer isolates the base surface of the club head component of the golf club head such that oxygen in the atmosphere cannot oxidize the base surface of the base surface of the club head component of the golf club head. Thereby, the rust-resistant coating layer carries out an increase of the antirust ability and hardness of the club head component of the golf club head.

13 Claims, 2 Drawing Sheets

GOLF CLUB HEAD HAVING A RUST-RESISTANT COATING FOR REINFORCING A SURFACE THEREOF

BACKGROUND OF THE INVENTION

1. Field of the Invention

The present invention relates to a golf club head having a rust-resistant coating for reinforcing a surface thereof. More particularly, the present invention relates to the golf club head having a rust-resistant coating layer which has a predetermined ratio of iron, cobalt and nickel, and performs a relatively high degree of the antirust ability and hardness.

2. Description of the Related Art

A conventional golf club head generally uses soft iron materials, low carbon steel or low alloy steel for example, having a relatively low degree of hardness so as to possess a greater control of striking a golf ball. The soft iron material used in the golf club head can extend a period of impacting time of the golf ball so that the golf club head is capable of controlling variations in rotations and flying directions within a certain extent while striking the golf ball. Disadvantageously, the soft iron material of the golf club head can be naturally and easily oxidized such that the material of the golf club head gathers or produces unwanted rust on its surface in normal usage of striking the golf ball.

To solve the above problem, the golf club industry made many attempts in various alloy metals in manufacturing the golf club head. Typically, a rust-resistant coating layer such as a nickel-coating or chromium-coating layer formed on a surface of the golf club head is widely used in the golf club head industry. In this way, the rust-resistant coating layer provides its antirust performance for the surface of the golf club head. For example, such a rust-resistant coating layer is disclosed in U.S. Pat. No. 5,131,986, entitled "golf club head and its manufacturing," U.S. Pat. No. 6,617,050, entitled "low density and high ductility alloy steel for a golf club head" and U.S. Pat. No. 6,679,787, entitled "golf shaft and golf club having the same" etc.

However, the constructional property of the nickel-coating or chromium-coating layer does not appear a sufficiently fine surface which is particularly formed on a surface of the golf club head with a higher degree of roughness. This disadvantage apparently occurs in electrochemical reaction. Accordingly, rustiness still occurs on 3% of the coated surface of the golf club head in a long-term salty mist test.

Hence, there is a need for improving the rust-resistant coating layer forming on the surface the golf club head body so as to enhance the antirust ability and hardness but to maintain its mechanical strength. Therefore, the application of the rust-resistant coating layer can be widened.

The present invention intends to provide a golf club head having a rust-resistant coating layer made from a Fe—Co—Ni alloy which has a predetermined ratio of iron, cobalt and nickel. The Fe—Co—Ni alloy of the rust-resistant coating layer includes iron of 5-20 wt %, cobalt of 5-25 wt % and nickel of 60-90 wt %, possesses the performance of a nanometer-scaled material, and carries out a high degree of a combination of the antirust ability and hardness in such a way to mitigate and overcome the above problem.

SUMMARY OF THE INVENTION

The primary objective of this invention is to provide a golf club head having a rust-resistant coating layer which has a predetermined ratio of iron, cobalt and nickel, and performs a relatively high degree of the antirust ability and hardness.

The golf club head in accordance with an aspect of the present invention includes a rust-resistant coating layer forming on a base surface of at least one club head component of the golf club head. The rust-resistant coating layer is made from a Fe—Co—Ni alloy including iron of 5-20 wt %, cobalt of 5-25 wt % and nickel of 60-90 wt %, which is a nanometer-scaled material. The rust-resistant coating layer isolates the base surface of the club head component of the golf club head such that oxygen in the atmosphere cannot oxidize the base surface of the base surface of the club head component of the golf club head. Thereby, the rust-resistant coating layer carries out an increase of the antirust ability and hardness of the club head component of the golf club head.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
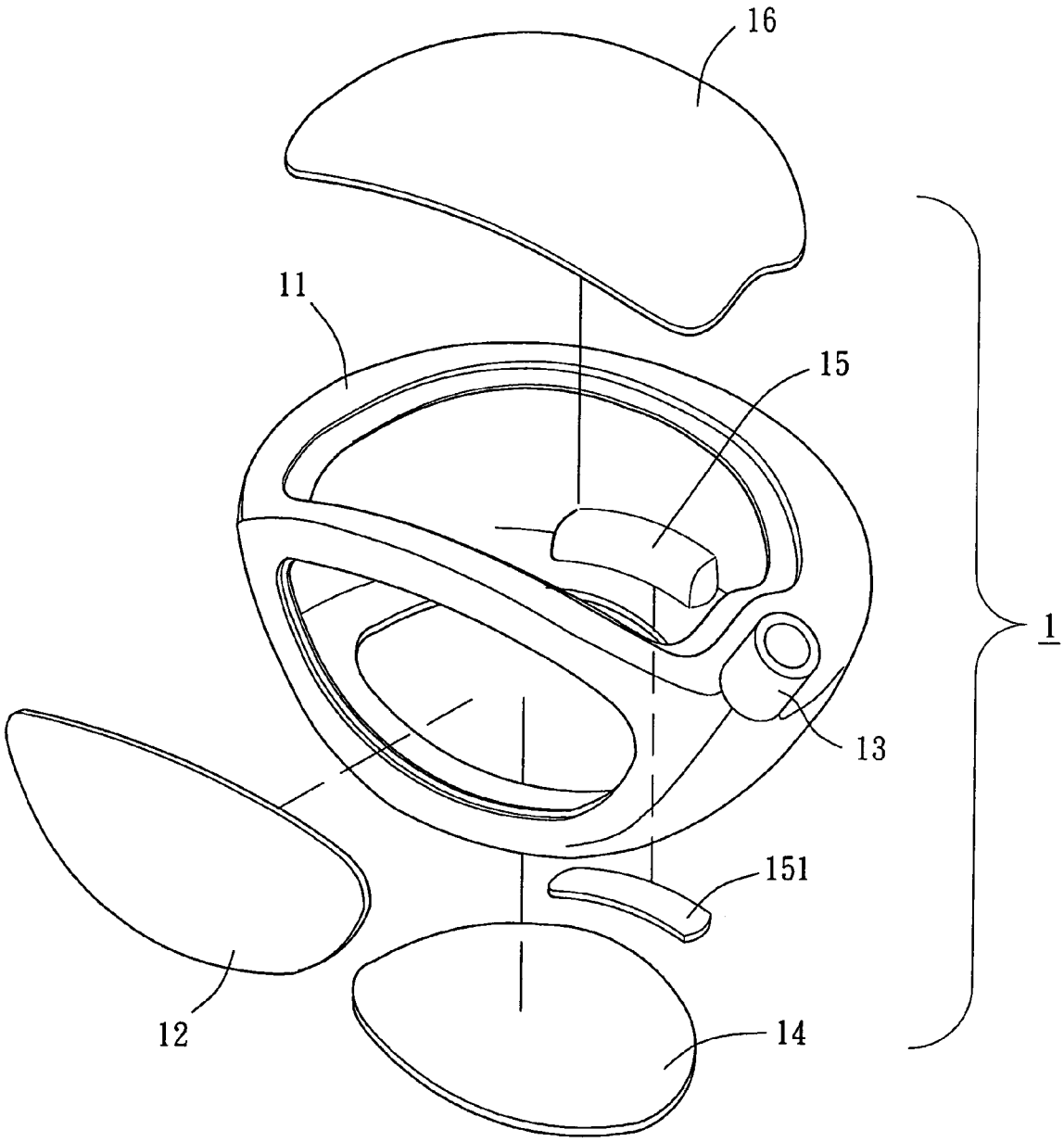
FIG. 1 is an exploded perspective view of a wood-type golf club head having a plurality of club head components on which to form a rust-resistant coating layer in accordance with a preferred embodiment of the present invention.
Figure 2:
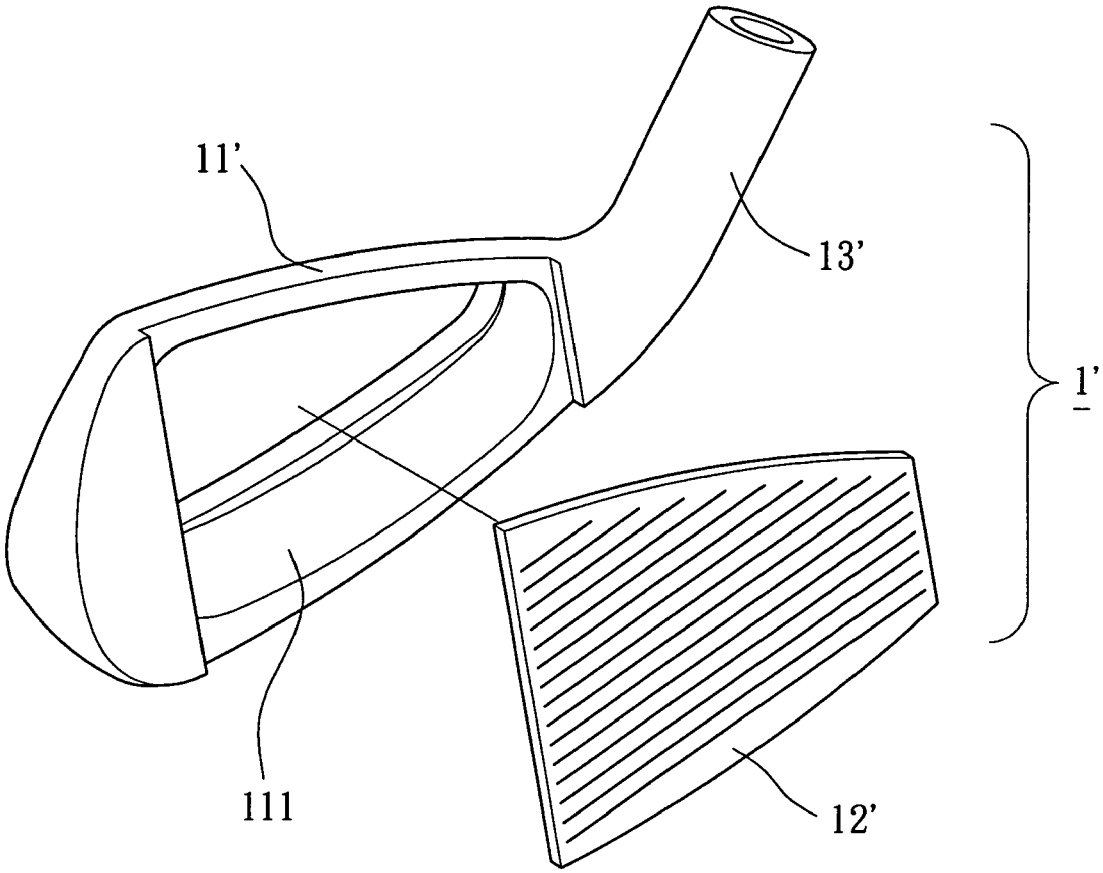
FIG. 2 is an exploded perspective view of an iron-type golf club head on which to form the rust-resistant coating layer in accordance with the preferred embodiment of the present invention.

Referring initially to FIGS. 1 and 2, a rust-resistant coating layer in accordance with the preferred embodiment of the present invention is generally applied to a golf club head. The golf club head applied in the present invention can be selected from a group consisting of a wood-type club head, an iron-type club head, a utility-type club head and a putter-type club head. In the following embodiments, the rust-resistant coating layer in accordance with the present invention shall be only applied to the wood-type club head designated numeral 1 and the iron-type club head designated numeral 1'. It will be understood that the rust-resistant coating layer applied to either; of the utility-type or putter-type club head in accordance with the present invention is omitted.

Still referring to FIGS. 1 and 2, the construction of the wood-type club head 1 and the iron-type club head 1' shall be described in detail. As shown in FIG. 1, the wood-type club head 1 in accordance with the preferred embodiment includes a plurality of club head components to constitute a sectional club head body. In an alternative embodiment, the wood-type club head 1 can be selected from a monolithic club head body or a one-piece club head body. The club head body of the wood-type club head 1 has a conventional configuration, and the club head components are connected with each other to form the club head body of the wood-type club head 1 by some other suitable methods, including precision casting, forging, machining, welding, brazing, snap-connecting, screw-connecting, adhesion or some other fastening means for instance. In the illustrated, preferred embodiment, the club head components of the wood-type club head 1 can be selectively made from suitable metal or nonmetal materials, and can further be formed either from similar or dissimilar materials. The materials of the wood-type club head 1 can be selected from carbon steel, including S20C, AISI 4130, AISI 8620 for example, stainless steel, including 17-4PH stainless steel for example, alloy steel, Fe—Mn—Al alloy, cast iron, nickel-based alloy, or super alloy steel.

Still referring to FIG. 1, the wood-type club head 1 in accordance with the preferred embodiment of the present invention has a hardness ranging between HRB75 and HRC40 in order to contain a period of impacting time for the wood-type club head 1 on a golf club head (not shown). Preferably, the club head components of the wood-type club head 1 includes a club head body 11, a striking plate 12, a hosel 13, a sole plate 14, a club weight member 15 (including an ornamental cover plate 151), a crown plate 16, a sidewall plate (not shown) or a rear wall plate (not shown).

Referring again to FIG. 2, the iron-type club head 1' in accordance with the preferred embodiment has a club head body 11' (including a hosel 13') and a striking plate 12' to commonly define an undercut configuration as well as an undercut portion. Preferably, the undercut configuration of the iron-type club head 1' is formed among a rear surface of the striking plate 12', a sole portion, a blade portion, a heel portion and a toe portion of the club head body 11'. The club head body 11' further includes an inner wall 111 delimiting an inner space so as to form the undercut configuration (i.e. undercut portion) of the iron-type club head 1'.

Figure 3:
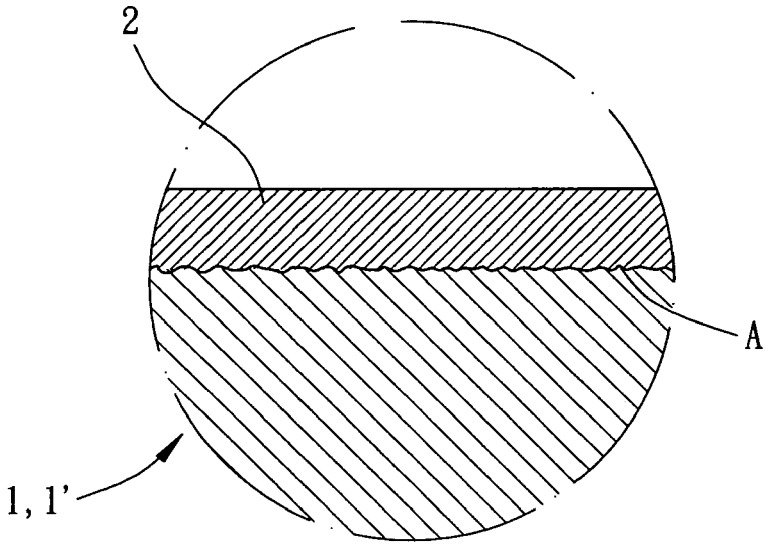
FIG. 3 is a partially enlarged cross-sectional view of the golf club head covered with the rust-resistant coating layer in accordance with the first embodiment of the present invention.

Turning now to FIG. 3, the rust-resistant coating layer 2 in accordance with the present invention is applied to a surface of the wood-type club head 1 or the iron-type club head 1'. The rust-resistant coating layer 2 is made from a Fe—Co—Ni alloy which has a predetermined ratio of iron having a density of 7.90 g/cm$^3$, cobalt having a density of 8.90 g/cm$^3$, and nickel having a density of 8.91 g/cm$^3$. In the preferred, illustrated embodiment, the Fe—Co—Ni alloy includes a ratio of iron of 5-20 wt %, cobalt of 5-25 wt % and nickel of 60-90 wt % such that the Fe—Co—Ni alloy can appear perfect antirust ability and hardness.

Still referring to FIGS. 1 through 3, the wood-type club head 1 or the iron-type club head 1' forms a prepared surface "A" on which to coat the rust-resistant coating layer 2. To accomplish this task, the prepared surface "A" has a specific roughness in the intended manner so that the rust-resistant coating layer 2 cover the prepared surface "A" of the wood-type club head 1 or the iron-type club head 1' with prefect adhesion. In this embodiment, the roughness of the prepared surface "A" of the club head is preferably less than Rmax 20.0 μm, particularly less than Rmax 10.0 μm, more particularly less than Rmax 6.0 μm. In an alternative embodiment, the prepared surface "A" can be eliminated on either of the wood-type club head 1 or the iron-type club head 1'. In the preferred embodiment, the rust-resistant coating layer 2 can coat on the prepared surface "A" of the wood-type club head 1 or the iron-type club head 1' by means of a method selected from electroplating, electroless plating, and physical vapor deposition (PVD) including evaporation and sputtering. As best shown in FIG. 2, the rust-resistant coating layer 2 can be used to cover the inner wall 111 of the iron-type club head 1'. Since the rust-resistant coating layer 2 appears a perfect antirust ability and hardness, the club head can permit forming a reduced thickness of the rust-resistant coating layer 2 ranging between 10 μm and 30 μm which can withstands normal usage. Accordingly, the process time for the rust-resistant coating layer 2 can be saved and shortened.

Still referring to FIG. 3, the construction of the rust-resistant coating layer 2 shall be described in detail. The rust-resistant coating layer 2 has a first surface and a second surface opposite to the first surface. Defined between the first surface and the second surface can be a predetermined thickness of the rust-resistant coating layer 2. Once formed, the first surface of the rust-resistant coating layer 2 is adhered to the prepared surface "A" of the wood-type club head 1 or the iron-type club head 1'. Accordingly, the second surface of the rust-resistant coating layer 2 is exposed on the club head.

In comparison with the conventional soft iron alloy, the Fe—Co—Ni alloy of the rust-resistant coating layer 2 having a predetermined ratio in accordance with the present invention can possess a combination of high strength and plastic characteristic. Accordingly, the Fe—Co—Ni alloy of the rust-resistant coating layer 2 is suitable for use in aiding several adjusting processes, an angle-adjusting process for example, following the manufacturing process. Furthermore, the Fe—Co—Ni alloy of the rust-resistant coating layer 2 can determine its performance of high strength (hardness) and wear resisting in addition to the antirust ability. In this way, the hardness of the Fe—Co—Ni alloy of the rust-resistant coating layer 2 is greater than 1,000 HV, and particularly even greater than 1,500 HV while the thickness is ranging between 10 μm and 30 μm.

In addition, the Fe—Co—Ni alloy of the rust-resistant coating layer 2 possesses a nano-crystalline structure so that the rust-resistant coating layer 2 can perform a higher fine surface which can isolate oxygen in the atmosphere from iron contained in the material of the club head. Advantageously, the nano-scaled material of the rust-resistant coating layer 2 of the club head can enhance the hardness and wear resisting, and cannot affect the mechanical characteristics of the club head such that the useful life of the club head is prolonged.

As has been discussed above, due to the low antirust characteristic of the conventional coating layer, the surface of the golf club head easily gathers rust in normal usage. Conversely, the rust-resistant coating layer 2 of the club head, as shown in FIG. 3, can perform a higher degree of the antirust ability and hardness. Accordingly, the designs for the wood-type club head 1 or the iron-type club head 1' can be widened by using the rust-resistant coating layer 2 with the predetermined ratio of iron, cobalt and nickel.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A golf club head having a rust-resistant coating, comprising:

at least one club head component having a prepared surface; and a rust-resistant coating layer forming on the prepared surface of the club head component, said rust-resistant coating layer made from a Fe—Co—Ni alloy including iron of 5-20 wt %, cobalt of 5-25 wt % and nickel of 60-90 wt %;

wherein said rust-resistant coating layer is formed with a nano-crystalline structure of the Fe—Co—Ni alloy.

2. The golf club head having the rust-resistant coating as defined in claim 1, with the rust-resistant coating layer forming on the club head component which is selected from a group consisting of a club head body, a striking plate, a hosel, a sole plate, a club weight member, an ornamental cover plate, a crown plate, a sidewall plate, a rear wall plate and an inner wall delimiting a undercut portion.

3. The golf club head having the rust-resistant coating as defined in claim 1, with the rust-resistant coating layer having a thickness ranging between 10 μm and 30 μm.

4. The golf club head having the rust-resistant coating as defined in claim 1, with the rust-resistant coating layer having a hardness greater than 1,000 HV.

5. The golf club head having the rust-resistant coating as defined in claim 1, with the rust-resistant coating layer forming on the prepared surface of the club head component by means of a method selected from electroplating, electroless plating, and physical vapor deposition (PVD).

6. The golf club head having the rust-resistant coating as defined in claim 1, with the rust-resistant coating layer forming on the prepared surface of the club head component which has a predetermined roughness.

7. The golf club head having the rust-resistant coating as defined in claim 6, wherein the roughness of the prepared surface is less than Rmax 20.0 μm, particularly less than Rmax 10.0 μm, more particularly less than Rmax 6.0 μm.

8. A rust resistant coating layer for a golf club head comprising: iron of 5-20 wt %, cobalt of 5-25 wt %, and nickel of 60-90 wt %, said rust resistant coating layer being formed with a nano-crystalline structure of a Fe—Co—Ni alloy with the rust resistant coating layer forming on a prepared surface formed on a club head component or a portion of the golf club head which has a predetermined roughness.

9. The rust-resistant coating layer for the golf club head as defined in claim 8, with the rust-resistant coating layer forming on the club head component which is selected from a group consisting of a club head body, a striking plate, a hosel, a sole plate, a club weight member, an ornamental cover plate, a crown plate, a sidewall plate, a rear wall plate and an inner wall delimiting a undercut portion.

10. The rust-resistant coating layer for the golf club head as defined in claim 8, with the rust-resistant coating layer having a thickness ranging between 10 μm and 30 μm.

11. The rust-resistant coating layer for the golf club head as defined in claim 8 with the rust-resistant coating layer having a hardness greater than 1,000 HV.

12. The rust-resistant coating layer for the golf club head as defined in claim 8, with the rust-resistant coating layer forming on the prepared surface of the club head component by means of a method selected from electroplating, electroless plating, and physical vapor deposition (PVD).

13. The golf club head having the rust-resistant coating as defined in claim 9, wherein the roughness of the prepared surface is less than Rmax 20.0 μm, particularly less than Rmax 10.0 μm, more particularly less than Rmax 6.0 μm.

* * * * *